US005542720A

United States Patent [19]

Fleming

[11] Patent Number: 5,542,720

[45] Date of Patent: Aug. 6, 1996

[54] MULTIPOINT LOCK ASSEMBLY FOR A SLIDING DOOR

[75] Inventor: Paul D. Fleming, Glendale, Calif.

[73] Assignee: W&F Manufacturing, Inc., Glendale, Calif.

[21] Appl. No.: 494,806

[22] Filed: Jun. 26, 1995

[51] Int. Cl.[6] ..... E05C 9/00

[52] U.S. Cl. ..... 292/32; 292/333; 292/341.15; 292/DIG. 46

[58] Field of Search ..... 292/32, 33, 333, 292/163, 341.15, DIG. 46

[56] References Cited

U.S. PATENT DOCUMENTS

| | | | |
|---|---|---|---|
| 2,734,764 | 2/1956 | Angelo | 292/333 |
| 2,793,896 | 5/1957 | Duvall | 292/333 X |
| 4,480,862 | 11/1984 | Fleming | 292/DIG. 46 |
| 4,597,599 | 7/1986 | Bisbing | 292/DIG. 51 X |
| 4,779,907 | 10/1988 | Yu | 292/333 X |
| 5,120,094 | 6/1992 | Eaton et al. | 292/DIG. 46 X |
| 5,290,077 | 3/1994 | Fleming . | |
| 5,373,716 | 12/1994 | MacNeil et al. . | |

FOREIGN PATENT DOCUMENTS

| | | | |
|---|---|---|---|
| 2228527 | 8/1990 | United Kingdom | 292/DIG. 46 |

*Primary Examiner*—Rodney M. Lindsey
*Attorney, Agent, or Firm*—Kelly Bauersfeld & Lowry

[57] ABSTRACT

A multipoint lock assembly is provided for securing a sliding door in a tightly closed and locked condition. The multipoint lock assembly comprises a plurality of latch cartridges mounted at vertically spaced positions along a free side edge of a sliding door, wherein the latch cartridges each include a keyhole-shaped latch port and are movable together for engaging headed latch pins mounted on an adjacent door jamb. A main actuator cartridge is mounted on the door for moving the latch cartridges to an unlatched position to permit door movement to an open position in response to rotation of a door handle. A trigger assembly retains the latch cartridges in the unlatched position until the door is closed, at which time the trigger assembly releases the latch cartridges for spring-loaded movement to a latched position engaging the latch pins. A security deadbolt is also provided on the main actuator cartridge and can be thrown when the door is closed for positively locking the door.

16 Claims, 4 Drawing Sheets

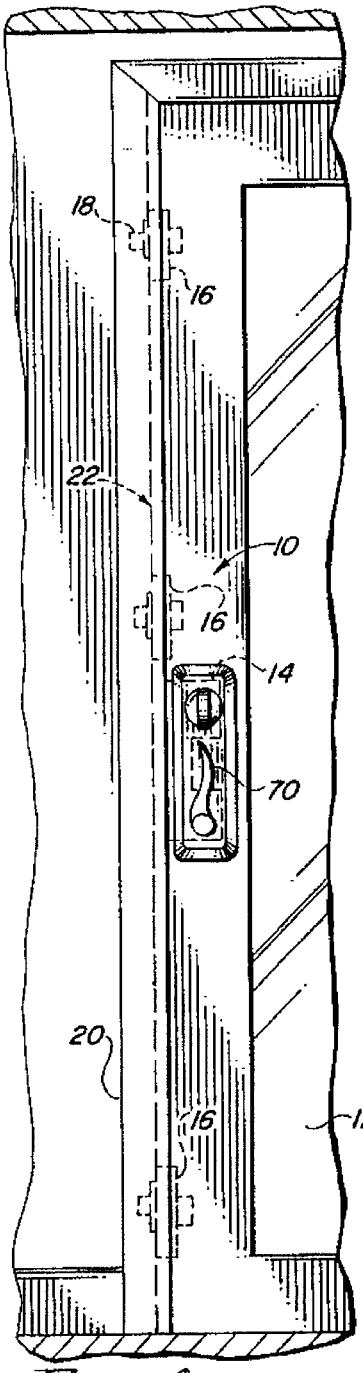
FIG. 1
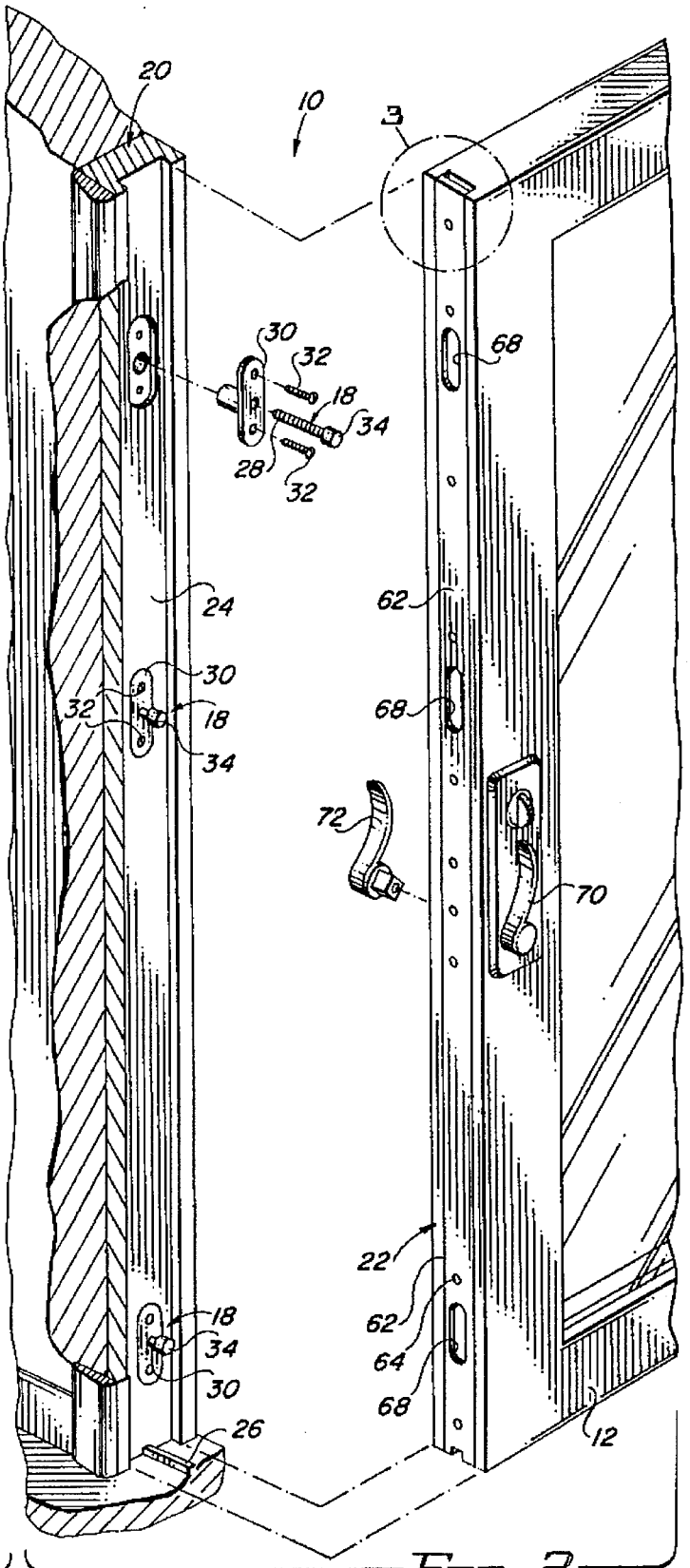
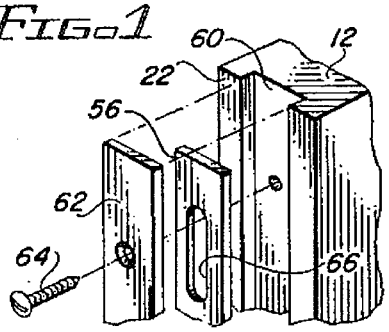
FIG. 3
FIG. 2

MULTIPOINT LOCK ASSEMBLY FOR A SLIDING DOOR

BACKGROUND OF THE INVENTION

This invention relates generally to an improved door lock assembly designed for secure multipoint locking of a door, particularly such as a sliding patio door. The improved multipoint lock assembly includes a plurality of latch cartridges recessed within a free side edge of a sliding door, and defining latch ports for engaging and latching with headed latch pins mounted on an adjacent door jamb.

Door lock and latch assemblies are generally known in the art for use in latching and locking doors, including hinged swinging doors and sliding so-called patio doors. These latch and lock assemblies typically include one or more latch members mounted along a free side edge of the door and adapted to engage with associated keeper devices mounted on an adjacent door jamb. Door handles or levers are normally included to operate the latch members in a manner to disengage from the associated keeper devices and thereby permit door opening movement. A security deadbolt is often provided as an additional lock structure for added security.

Although latch and lock assemblies of the general type described above have performed in a satisfactory manner, there has existed a continuing desire and need for further improvements in high security lock assemblies designed to safely and positively lock a door against unauthorized entry. Toward this end, so-called multipoint lock assemblies have been proposed with multiple lock members provided along the door side edge for engaging a corresponding number of keeper devices mounted on the adjacent door jamb. In some instances, the multiple lock members are designed for independent actuation, with the unfortunate result that some of the lock members are frequently left disengaged due to human forgetfulness and/or neglect. In other designs, the multiple lock members are adapted for concurrent actuation from a single actuator handle or lever. Many of these systems have tended to be relatively difficult to assemble and to install in a cost effective manner.

One improved multipoint lock assembly is described in commonly assigned U.S. Pat. No. 5,373,716, wherein a plurality of latch pins are mounted along the free side edge of a swinging door for releasible latched engagement with strike or keeper plates mounted on an adjacent door jamb. The latch pins are associated with a trigger assembly which retains the latch pins in a retracted position when the door is opened, but which releases the latch pins for spring-loaded displacement to a latched position when the door is closed. This latch pin concept, as disclosed in U.S. Pat. No. 5,373,716, presents a convenient and relatively simple yet versatile construction for improved multipoint latching of a hinged door. Unfortunately, this multipoint latch concept has not been well suited for use in a sliding door, of the type used in a residence for access to patios, etc.

The present invention specifically provides an improved multipoint lock assembly having a plurality of latch pins and a related trigger assembly adapted for secure multipoint latching or a sliding door.

SUMMARY OF THE INVENTION

In accordance with the invention, an improved multipoint lock assembly is provided for use in secure latching and locking of a sliding door. The multipoint lock assembly comprises a plurality of latch cartridges mounted at vertically spaced positions along a free side edge of a sliding door. The latch cartridges each include a latch plate with a keyhole-shaped latch port formed therein. The latch cartridges are movable together for respectively engaging and latching with headed latch pins mounted on an adjacent door jamb. A trigger assembly retains the latch cartridges in unlatched positions when the door is opened, but automatically releases the latch cartridges for spring-loaded movement to a latched condition when the door is closed.

More specifically, in a preferred form of the invention, the plurality of latch cartridges are mounted along the free side edge of the sliding door in recessed or nested positions and are interconnected by a vertically elongated and slidably movable drive bar operated by a main actuator cartridge having indoor and outdoor handles. The latch cartridges are individually associated with corresponding headed latch pins mounted on the adjacent door jamb. The latch pins have enlarged heads thereon and a size and shape for reception through a large portion of the associated keyhole latch port of the associated latch cartridge, after which the latch cartridge is shifted vertically along the door side edge to secure the latch pin head behind the latch plate, with the pin shank projecting through a smaller portion of the keyhole port.

Rotation of either door handle in an opening direction unlatches the latch cartridges and thereby permits door opening. Specifically, the rotated door handle is connected to the latch cartridges by a sliding drive bar or the like to vertically shift the latch cartridges in a direction re-aligning the larger portions of the keyhole ports with the latch pin heads. The trigger assembly is cocked during this motion to releasibly retain the latch cartridges in this unlatched condition, so that the door can be slidably opened. Upon subsequent closure of the door, one of the latch pins engages and releases the trigger assembly to release the latch cartridges for spring-loaded return movement to the latched condition, thereby re-latching the door.

The main actuator cartridge, in the preferred form, also includes a security deadbolt which can be thrown when the door is closed and latched, for positively and separately locking the door in the closed position.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented indoor side elevational view depicting the free side edge of a sliding door in a closed condition with respect to an adjacent door jamb, wherein the door and jamb are equipped with the improved multipoint lock assembly embodying the novel features of the invention;

FIG. 2 is an enlarged fragmented exploded perspective view illustrating the free side edge of the sliding door in association with the adjacent door jamb;

FIG. 3 is an enlarged fragmented exploded perspective view of a portion of the door side edge, corresponding generally with the encircled region 3 of FIG. 2;

DETAILED DESCRIPTION OF THE PREFERRED EMBODIMENT

Figure 4:
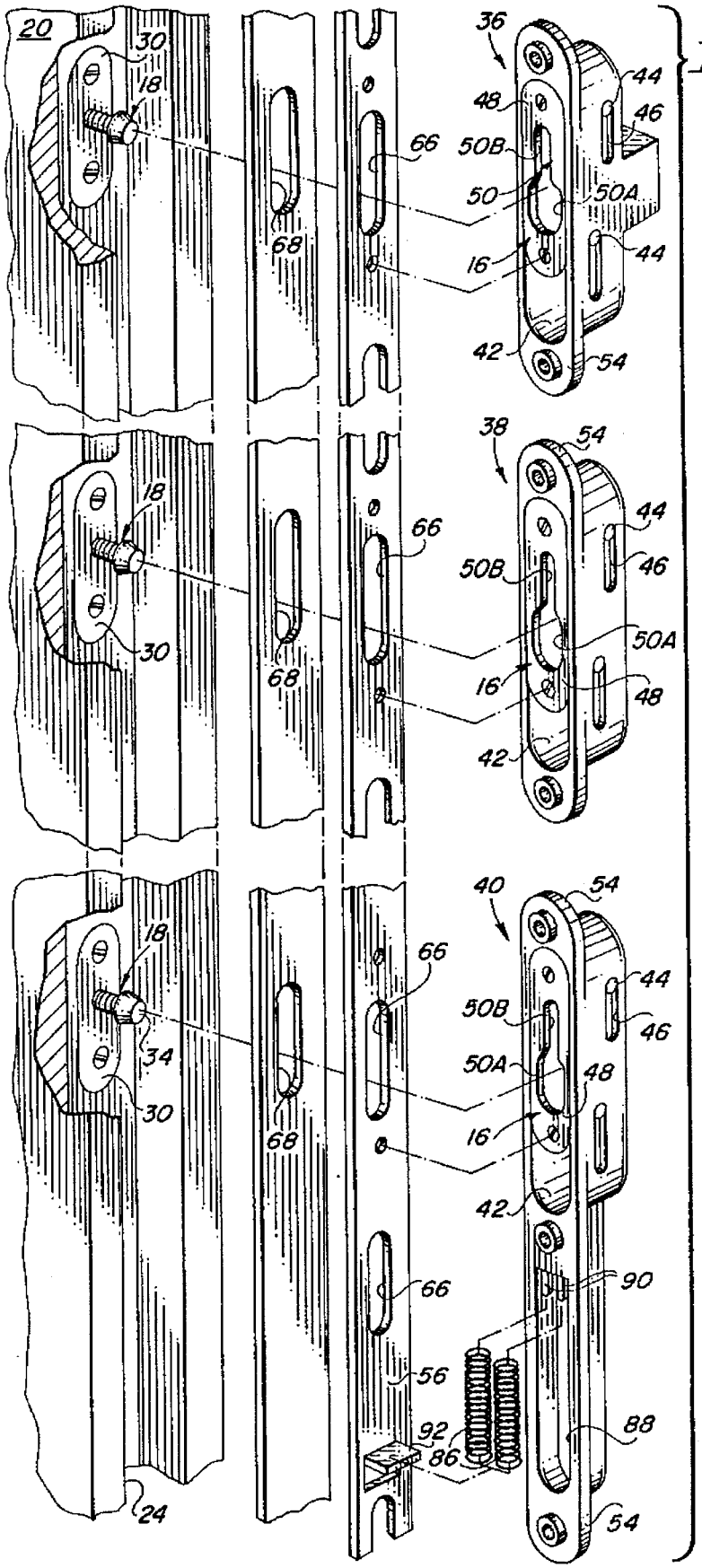
FIG. 4 is an enlarged and fragmented exploded perspective view depicting components of the multipoint lock assembly in association with the adjacent door jamb.

As shown in the exemplary drawings, an improved multipoint lock assembly referred to generally by the reference numeral 10 in FIG. 1 is provided for high security latching and locking of a sliding door 12 in a tightly closed condition. The multipoint lock assembly 10 includes a single or main actuator cartridge 14 for displacing a plurality of movable latch cartridges 16 from a latched position to an unlatched position, relative to a corresponding plurality of headed latch pins 18 (FIG. 2) mounted along an adjacent door jamb 20. A trigger assembly (not shown in FIGS. 1 and 2) retains the latch cartridges 16 in an unlatched position, until the door is returned to a closed position, at which time the latch cartridges are released for spring-loaded displacement to the latched positions engaging and latching with the headed latch pins 18.

As shown generally in FIGS. 1–4, the multiple latch cartridges 16 are mounted in a recessed or nested manner along a free side edge 22 of the sliding door 12, at vertically spaced positions in general alignment with the headed latch pins 18 on the door jamb 20. In this regard, the door jamb 20 is typically constructed to include a generally U-shaped and vertically elongated channel 24 for partial reception of the door side edge 22, when the door 12 is displaced along a slide track 26 to a closed position. The latch pins 18, three of which are shown in the illustrative embodiment of the invention, include elongated pin shanks 28 (FIG. 2) having one end secured to a mounting bracket 30 is attached to the door jamb 20 at the base of the channel 24 by means of screws 32 or the like. The opposite end of the pin shank 28 of each latch pin 18 terminates in a relatively larger diameter head 34 for latching engagement with the associated latch cartridges 16, as will be described.

The latch cartridges 16, three of which are shown in the illustrative drawings, are mounted along the free side edge 22 of the sliding door 12 for latching interengagement with the headed latch pins 18. As shown best in FIG. 4, each latch cartridge 16 is mounted within a hollow latch case 36, 38 and 40 for reciprocal vertical displacement through a short stroke. The three latch pin cartridges 16 may be and preferably are identical, but the three associated latch cases 36, 38 and 40 are somewhat different in construction to accommodate the desired functional operation of the mechanism, as will be described. Each latch cartridge 16 is slidably carried within a vertically elongated slot 42 in the associated latch case, by means of slide pins 44 passed laterally through the cartridge 16 and guidably seated within vertically elongated cam slots 46 in the side walls of the associated latch case. A latch plate 48 is defined on the latch cartridge 16, with a keyhole-shaped latch port 50 formed therein. As shown, this keyhole latch port has a lower portion 50A which is larger or wider than a narrower upper portion 50B. The three latch cases 36, 38 and 40 are mounted within the door side edge by means of screws 52 or the like passed through latch case flanges 54.

The three latch cartridges are driven together by means of a drive bar 56 which extends from the main actuator cartridge 14 and is attached to the latch plate 48 by screws 58 or similar fastener devices. As shown in FIGS. 2 and 3, this drive bar 56 is desirably concealed and nested within a shallow track 60 formed in the free side edge 22 of the door, with an overlying stationery face plate 62 mounted thereover and attached to the door side edge by screws 64 or the like. Importantly, the drive bar 56 has elongated slots 66 formed therein to accommodate the desired reciprocal vertical sliding motion behind the stationary face plate 62. Through ports 68 are formed in the face plate 62 to accommodate passage of the headed latch pins 18 into operative relation with the latch cartridges 16, disposed behind the face plate 62, as will be described in more detail.

Figure 10:
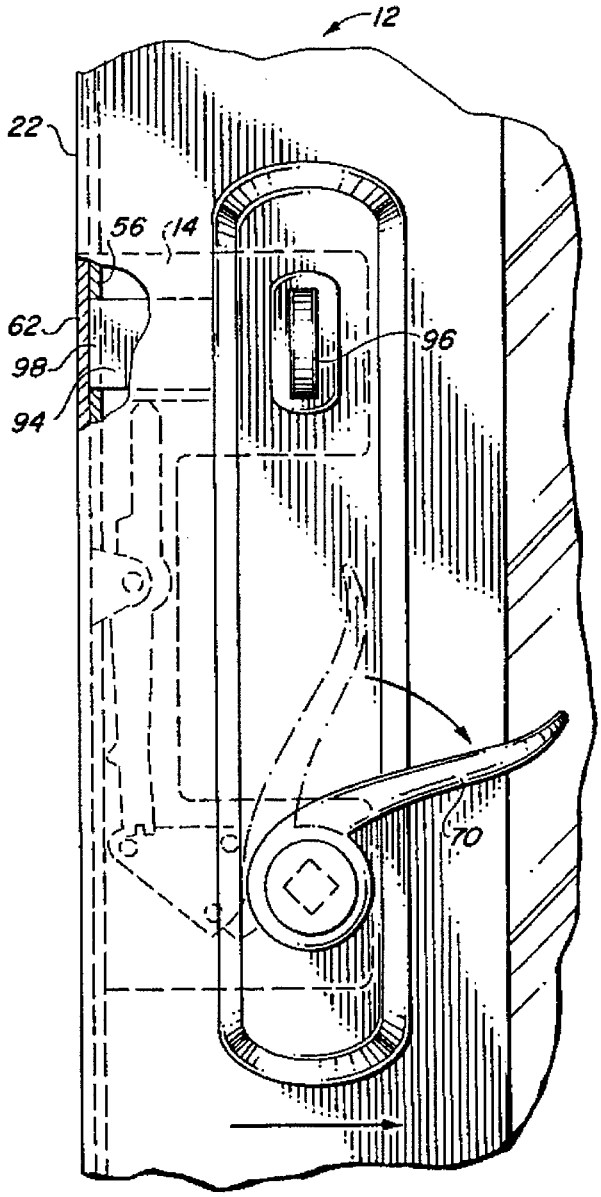
FIG. 10 is an enlarged fragmented indoor side elevational view depicting a main actuator cartridge for use in the invention.

With reference to FIGS. 2 and 10, the main actuator cartridge 14 is associated with an indoor handle 70 and an outdoor handle 72 in the form of rotatable levers used to open the door. FIG. 10 shows rotation of the indoor handle 72 in an opening direction, through a stroke of about 45 degrees, to operate the main actuator cartridge 14 in a manner shifting the drive bar 56 in a vertical direction. One preferred mechanism for the main actuator cartridge 14, to accomplish this function, is described in detail in commonly assigned U.S. Pat. No. 5,373,716, which is incorporated by reference herein, although persons skilled in the art will recognize that a range of alternative mechanisms may be used to accomplish this function. Rotation of the indoor handle 70 (or the outdoor handle 72) shifts the drive bar 56 in an upward direction to correspondingly shift the latch cartridges 16 in an upward direction to align the larger lower portion 50A of the keyhole latch ports 50 with the headed latch pins 18. In this position, referred to as the unlatched position, the door handle 70, 72 can be pulled to move the door 12 toward an open position with the side edge 22 spaced from the door jamb 20.

In accordance with one important aspect of the invention, a trigger assembly is associated with the uppermost latch case 36 and related latch cartridge 16 to retain the multiple latch cartridges 16 in the unlatched position when the door is open. The trigger assembly is referred to generally in FIGS. 5–7 by the reference numeral 74, and comprises a horizontally movable trigger button 76 biased by a spring 78 seated within an extension pocket 80 formed as part of the upper latch case 36. When the associated latch cartridge 16 is moved upwardly to the unlatched position, as viewed in FIG. 6, a trigger tab 82 on the trigger button 76 is advanced by the spring 78 into locking engagement with a trigger notch 84 ( FIG. 5) formed in the latch cartridge 16. Engagement between the trigger tab 82 and the associated notch 84 functions to retain all three latch cartridges 16 in the upper or unlatched position, by virtue of the interconnection of those latch cartridges 16 by the drive bar 56.

Figure 8:
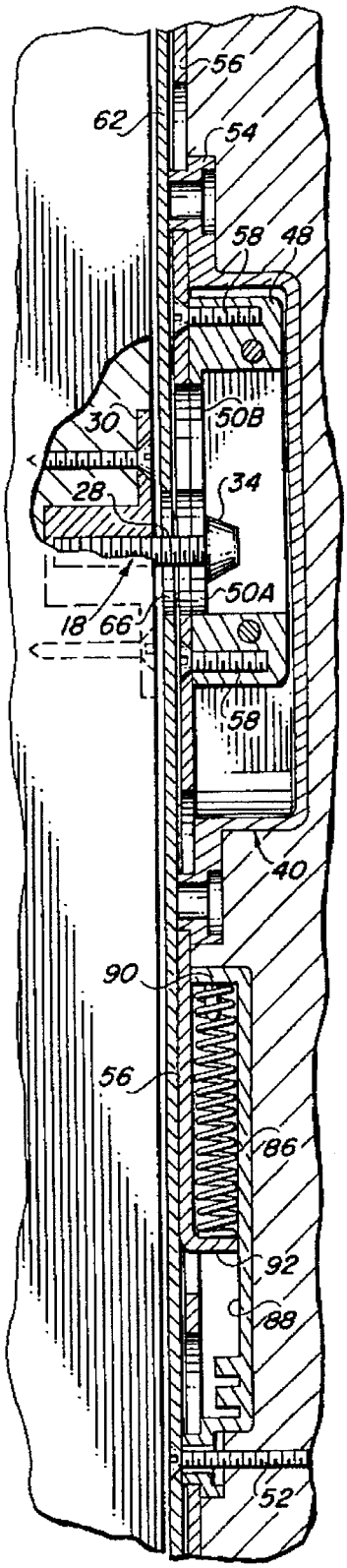
FIG. 8 is a fragmented vertical sectional view showing another latch case and related latch cartridge in an unlatched condition, including drive spring means for spring-loaded movement to a latched position.
Figure 9:
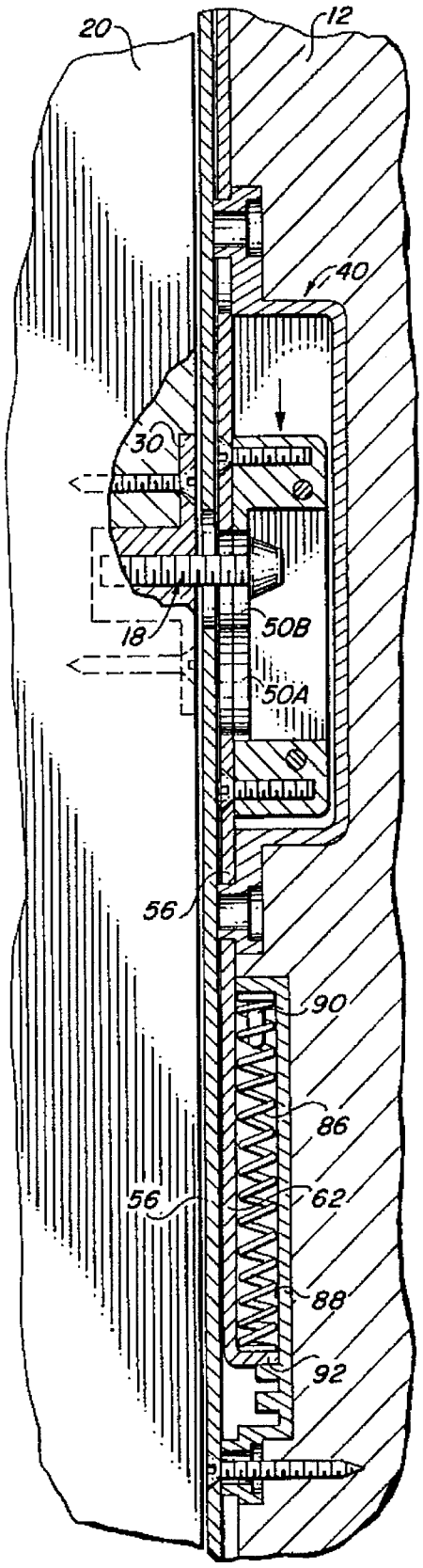
FIG. 9 is an enlarged fragmented sectional view similar to FIG. 8, and showing the latch cartridge in the latched position.

The trigger assembly 74, in general terms, also includes a pair of drive springs 86 mounted within a spring extension pocket 88 of the lower latch case 40. More specifically, as shown in FIGS. 4, 8 and 9, this lower spring extension pocket 88 includes a pair of mount pins 90 for retaining a pair of coil-type drive springs in parallel, vertically extending relation, with the lowermost ends of those springs engaging a drive tab 92 turned inwardly from the drive bar 56 to extend part-way into the pocket 88. When the drive bar 56 is displaced in an upward direction to move the latch cartridges 16 to the unlatched position, the drive springs 86 are compressed within the pocket 88. However, engagement of the trigger tab 82 (FIG. 5) with the trigger notch 84 at the upper latch case 36 prevents the drive springs 86 from returning the drive bar 56 and the associated latch cartridges 16 in a downward direction, when the door handle is released.

Figure 5:
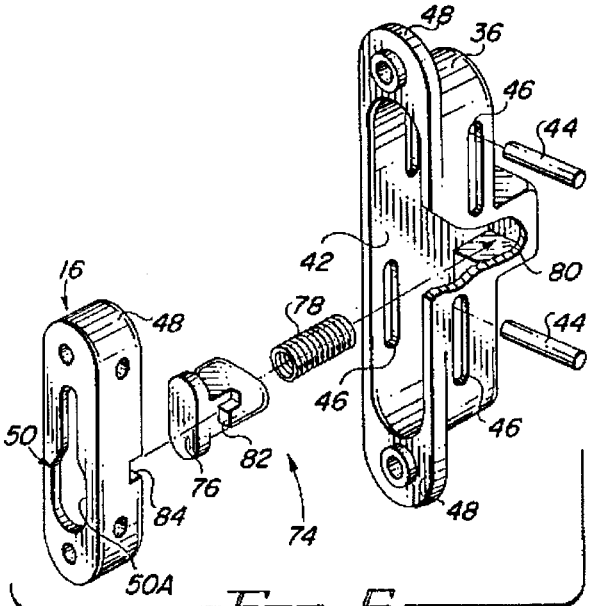
FIG. 5 is an exploded perspective view illustrating construction of one latch case including a movable latch cartridge and associated trigger button mounting along the door side edge.
Figure 6:
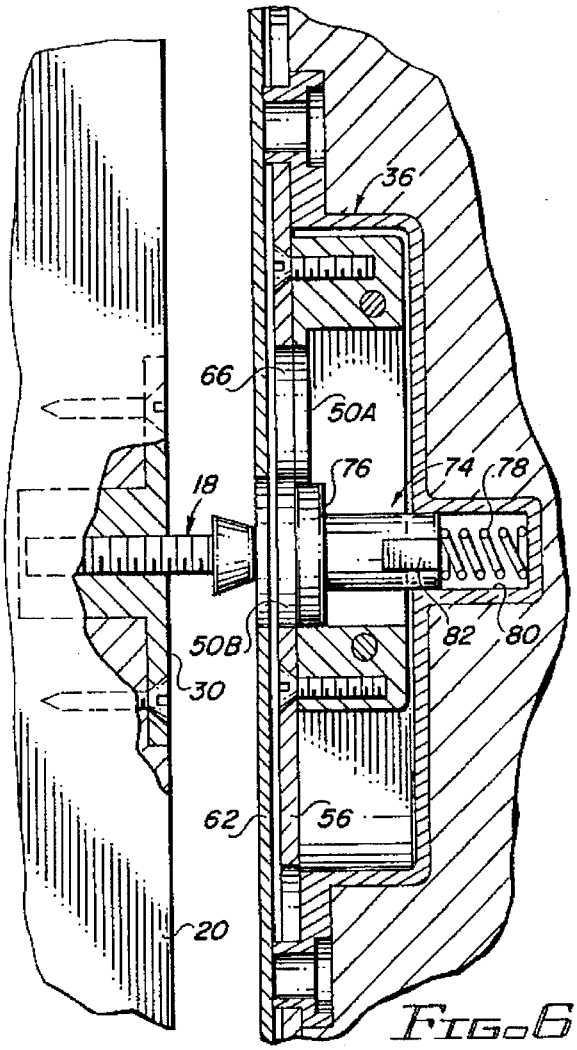
FIG. 6 an enlarged fragmented vertical sectional view illustrating the latch case of FIG. 6 in an unlatched position, in association with the adjacent door jamb.
Figure 7:
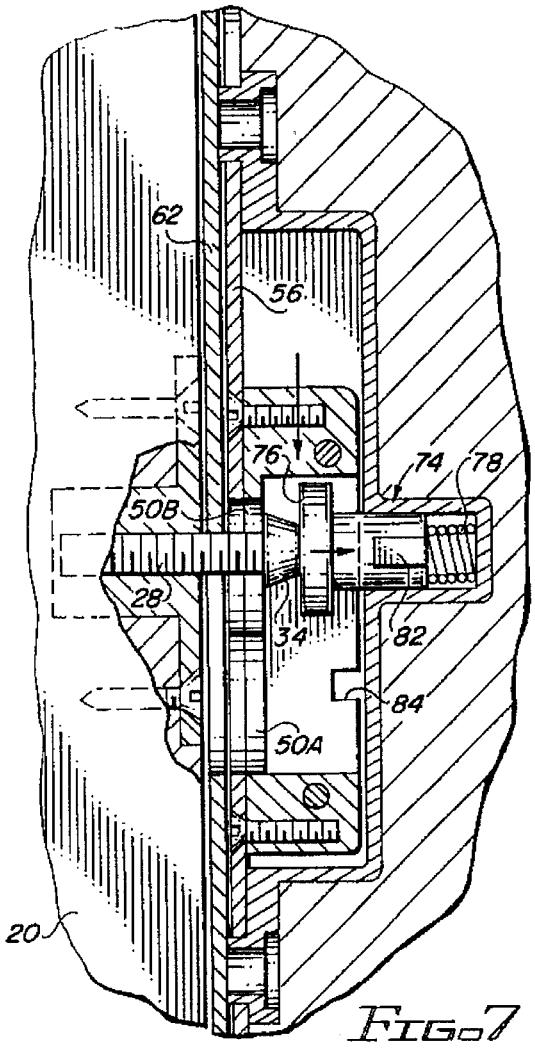
FIG. 7 is an enlarged fragmented sectional view similar to FIG. 6, but depicting the latch cartridge in a latched position.

Subsequent door closure, however, activates the trigger assembly 74 for spring-driven return movement of the latch cartridges 16 to the lower or latched position. That is, as shown in FIGS. 5–7, subsequent door closure causes the uppermost headed latch pin 18 to engage the trigger button 76 when that latch pin passes through the larger lower portion 50A of the keyhole port 50. The latch pin 18 thus depresses the trigger button 76 to retract the trigger tab 82 from the trigger notch 84, and thereby release the drive bar 56 for downward displacement in response to extension of the lower drive springs 86. This downward displacement is accompanied by downward displacement of the latch cartridges 16 to a latched position, as shown in FIGS. 7 and 9. In this latched position, the heads 34 of the latch pins 18 are disposed behind the keyhole ports 50 of the latch plates 48, with the pin shanks 28 extending through the narrower upper portions 50B of the keyhole ports 50. In this configuration, attempted door opening is preventing as the pin heads 34 engage the blind sides of the latch plates 48 of each latch cartridge, at a location behind the narrower portions 50B of the keyhole ports. Door re-opening is thus prevented, unless and until one of the door handles 70, 72 is again manipulated to shift the latch cartridges 16 back to the upper unlatched positions, with the trigger button 76 and its trigger tab 82 reengaged with the trigger notch 84, as previously described.

Figure 11:
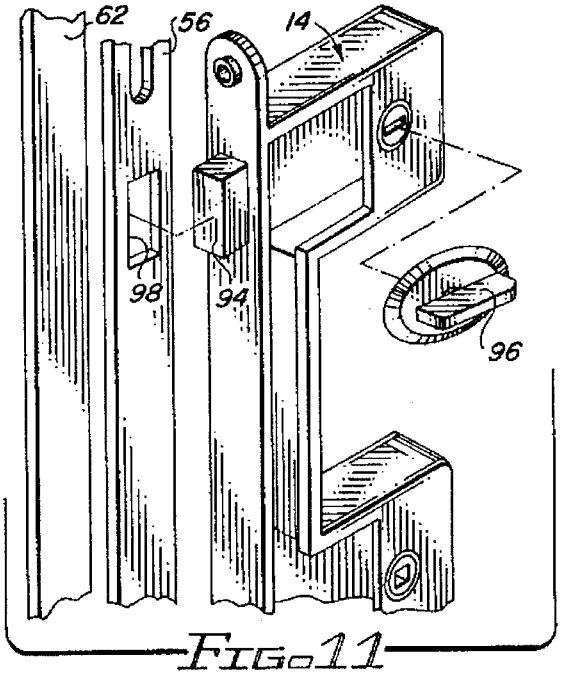
FIG. 11 is an exploded fragmented and perspective view depicting operation of a security deadbolt included as part of the main actuator cartridge.

In accordance with a further aspect of the invention, the main actuator cartridge 14 additionally includes a deadbolt 94 adapted for movement between a thrown position and a retracted position by manipulation of an appropriate device such as an indoor thumbturn 96 or an outdoor accessed key cylinder (not shown). The deadbolt 94 is associated with a matingly shaped deadbolt port 98 (FIG. 11) for receiving the deadbolt 94 in the thrown position. Importantly, the deadbolt port 98 is formed in the drive bar 56 and is aligned with the deadbolt 94 for reception thereof, if and only if the drive bar 56 is in the lower position with the latch cartridges 16 in the latched positions engaging the headed latch pins 18. The deadbolt 94 does not need to protrude through the stationary faceplate 62, and further does not need to protrude into the adjacent door jamb 20. Rather, by locking the drive bar 56 against vertical displacement, without protruding beyond the face plate 62, the deadbolt 94 effectively and securely prevents subsequent reopening of the door.

The multipoint lock assembly 10 of the present invention thus provides an easily operated high security lock device for use with a sliding door. Multiple latch cartridges engage and latch with associated multiple latch pins in an automatic manner upon door closure, to provide safe and secure door latching. High security locking in the closed position is obtained by advancement of a deadbolt, as described.

A variety of further modifications and improvements to the invention will be apparent to those skilled in the art. Accordingly, no limitation on the invention is intended by way of the foregoing description and accompanying drawings, except as set forth in the appended claims.

What is claimed is:

1. A door lock assembly for use in locking a sliding door, said lock assembly comprising;

a plurality of latch cartridges for mounting along a free side edge of a sliding door, each of said latch cartridges defining a vertically extending keyhole latch port with a wider first portion and a narrower second portion;

means for movably supporting said latch cartridges at vertically spaced positions along the door free side edge for vertical movement between a latched position and an unlatched position;

spring means for urging said latch cartridges normally toward said latched position;

trigger means for releasibly retaining said latch cartridges in said unlatched position;

a plurality of latch pins for mounting onto a door jamb adjacent the door free side edge, each of said latch pins including a narrow shank projecting from the door jamb and terminating in a wider head, said latch pins being mounted on the door jamb at vertically spaced positions for reception of said latch pin heads respectively through the wider first portions of said latch ports when the door is closed with said latch cartridges in the unlatched position, at least one of said latch pins thereupon engaging said trigger means to release said latch cartridges for spring-loaded movement to the latched position with said latch pin heads disposed behind the narrower second portions of said latch ports to prevent door opening; and actuator means for displacing said latch cartridges from the latched position to the unlatched position to align said latch pins with the wider first portions of said latch ports and permit door opening, said trigger means being cocked upon movement of said latch cartridges to the unlatched position to releasibly retain said latch cartridges in the unlatched position.

2. The door lock assembly of claim 1 wherein said latch cartridges are nested within the door free side edge.

3. The door lock assembly of claim 1 wherein a plurality of latch cases are mounted at vertically spaced positions nested with the door free side edge, said plurality of latch cartridges being respectively positioned within said latch cases for movement between the latched and unlatched positions, said actuator means comprising a drive bar interconnecting said latch cartridges for movement together between the latched and unlatched positions, said actuator means further including a main actuator assembly having an indoor handle and an outdoor handle and means responsive to movement of one of said handles for shifting said drive bar to displace said latch cartridges from the latched position to the unlatched position.

4. The door latch assembly of claim 3 wherein said main actuator assembly further includes a deadbolt, and means for throwing said deadbolt to a locked position when said latch cartridges are in the latched position.

5. The door lock assembly of claim 4 wherein said drive bar has a deadbolt port formed therein in a position for aligned reception of said deadbolt when said latch cartridges are in the latched position.

6. The door lock assembly of claim 5 further including a face plate mounted on the door free side edge in a position over said drive bar and said latch cartridges, said face plate having openings therein to exposed said latch ports in said latch cartridges.

7. The door lock assembly of claim 6 wherein said face plate conceals the deadbolt port formed in said drive bar.

8. The door lock assembly of claim 3 wherein said trigger means comprises a spring-loaded trigger button carried by one of said latch cases, said trigger button and the associated latch cartridge having an interengageable tab and notch for spring-loaded engagement with each other to retain said latch cartridges in the unlatched position when said latch cartridges are moved to the unlatched position, said trigger button being exposed for engagement by the associated latch pin when the door is closed to disengage said tab and notch to permit spring-loaded movement of said latch cartridges from the latched position to the unlatched position.

9. The door lock assembly of claim 8 wherein said spring means is mounted at another one of said latch cases to react between said another latch case and said drive bar for urging said drive bar in a direction displacing said latch cartridges to the latched position.

10. The door lock assembly of claim 1 wherein said plurality of latch cartridges comprises at least two latch cartridges.

11. A door lock assembly for use in locking a sliding door, said lock assembly comprising:

at least one latch cartridge for mounting along a free side edge of a sliding door, said latch cartridge defining a vertically extending keyhole latch port with a wider first portion and a narrower second portion;

means for movably supporting said latch cartridge for vertical movement along the door face side edge between a latched position and an unlatched position;

spring means for urging said latch cartridge normally toward said latched position;

trigger means for releasibly retaining said latch cartridge in said unlatched position in response to movement of said latch cartridge to the unlatched position;

a latch pin for mounting onto a door jamb adjacent the door free side edge, said latch pin including a narrow shank projecting from the door jamb and terminating in a wider head, said latch pin being mounted on the door jamb for reception of said head through the wider first portion of the latch port when the latch cartridge is in the unlatched position and the door is closed, said latch pin tripping said trigger means upon such door closure to release said latch cartridge for spring-loaded movement to the latched position with said head disposed behind the narrower second portion of the latch port to prevent door opening; and actuator means for displacing said latch cartridge from the latched position to the unlatched position to align the wider portion of said latch port with said latch pin and thereby permit door opening, said trigger means being cocked upon movement of said latch cartridge to the unlatched position to releasibly retain said latch cartridge in the unlatched position.

12. The door lock assembly of claim 11 wherein said latch cartridge is nested within the door free side edge.

13. The door lock assembly of claim 11 wherein a hollow latch case is mounted in a nested position with the door free side edge, said latch cartridge being slidably mounted within said latch case for guided movement between the latched and unlatched positions.

14. The door lock assembly of claim 13 wherein said actuator means includes movable handle means mounted on the door, and drive means connected between said handle means and said latch cartridge for moving said latch cartridge from the latched position to the unlatched position.

15. The door lock assembly of claim 14 wherein said drive means defines a deadbolt port, and said actuator means further including a deadbolt movable to a locked position extending into said deadbolt port when said latch cartridge is in the latched position.

16. The door lock assembly of claim 13 wherein said trigger means comprises a trigger button mounted on said latch case, said trigger button and said latch cartridge having an interengageable tab and notch for spring-loaded engagement with each other when the latch cartridge is moved to the unlatched position to releasibly retain said latch cartridge in the unlatched position, said latch pin being engageable with said trigger button when the door is closed to disengage said tab and notch and thereby permit spring-loaded movement of said latch cartridge to the latched position.

* * * * *